US005115534A

United States Patent [19]

Fournier

[11] Patent Number: 5,115,534

[45] Date of Patent: May 26, 1992

[54] ROTARY PAINT REMOVED DEVICE

[76] Inventor: Raymond R. Fournier, Box 528, R.D. 1, Oxford, N.J. 07863

[21] Appl. No.: 659,721

[22] Filed: Feb. 19, 1991

[51] Int. Cl.[5] ..... A46B 13/02; A46B 3/08; A46B 7/04

[52] U.S. Cl. ..... 15/179; 15/23; 15/191 R; 15/194; 15/200

[58] Field of Search ..... 15/23, 24, 28, 104.1 R, 15/179, 183, 191 R, 200, 89, 93 R, 194, 104.2; 30/276, 122; 29/81.11, 81.12

[56] References Cited

U.S. PATENT DOCUMENTS

| | | | |
|---|---|---|---|
| 2,215,514 | 9/1940 | MacGregor | 15/104.2 |
| 2,626,413 | 1/1953 | Girton | 15/179 X |
| 3,314,095 | 4/1967 | Prange | 15/200 |
| 4,780,992 | 11/1988 | McKervey | 15/28 |

FOREIGN PATENT DOCUMENTS

| | | | |
|---|---|---|---|
| 237965 | 8/1925 | United Kingdom | 15/200 |

*Primary Examiner*—Edward L. Roberts
*Attorney, Agent, or Firm*—Kenneth P. Glynn

[57] ABSTRACT

The present invention is directed toward a device that is adapted to the working end of a rotating string grass trimming tool. The standard string and spool end effector of the grass trimming tool is removed and the present invention is substituted in its place. The present invention is comprised of a drum which is rotated at a high rate of speed by the prime mover of the grass trimming tool. The drum has a plurality of flexible bristles extending from its circumferential surface. The centrifugal force of the rotating drum extends the flexible bristles away from the surface of the drum. The extended bristles are then brought into contact with a desired surface, removing any paint, rust or other unwanted material from the surface with a minimal or surface damage to that surface. The rate at which the present invention is rotated is controlled by the motor governing device of the grass trimming tool.

20 Claims, 3 Drawing Sheets 1
3
5
7
9
11
13
15
17
19
21
A
A 40
41
43
45
47
39
49
51
53
55

ROTARY PAINT REMOVED DEVICE

BACKGROUND OF THE INVENTION

1. Field of the Invention

The present invention is directed toward a paint stripping attachment apparatus, and more particularly to such attachment apparatuses that connecte to the working end of rotating string grass trimming tools, adapting the prime mover of the grass trimming tool to rotate a paint stripping head.

2. Prior Art Statement

Rotating heads having wire bristles, have been used to remove paint, rust and other unwanted materials from surfaces for decades. The working head is usually connected to an electric drill or other power tool that provides the rotational energy to spin the working head. Once rotating, the working head is brought into contact with a surface, the spinning bristles of the working head contact the desired surface removing any foreign material that may be present. In most all existing prior art, the prime mover used to rotate the working head is an electric motor dedicated to an existing power tool, such as a drill or a grinding machine. These machines have limited power and attachment means. Therefore the wire bristle working head, attached to such machines, is usually small and has a narrow working area, and can be safely rotated at the limited speeds.

Regardless of the disadvantages of size, traditional wire bristle working heads are highly limited in their applications and effectiveness. Traditional wire bristle working heads are attached to existing power tools, these tools may be heavy, difficult to maneuver, and often require a user to hold the tool over his head or to bend over to hold the tool close to the floor. The accumulation of all these limitations result in a product that is dangerous, inefficient and ineffective.

The present invention addresses the inherent problems of traditional wire bristle working heads in a unique and novel manner. The present invention is so formed so that it can be easily adapted to an existing rotating string grass trimming tool. Such tools are common to many households and are driven either by a high powered electric motor or a small internal combustion engine. The present invention is formed with an adaptive means so that the present invention can replace the existing end effector on the grass trimming tool. Once connected the present invention is rotated with all the speed and power of the existing prime mover. This available power is far greater than that of ordinary hand-held electric power tools and allows the present invention paint stripper to be larger and more effective than previously possible.

The present invention is made of a plurality of flexible bristles made of wire, string or similar flexible material. As the plurality of flexible bristles are rotated, the centrifugal force of the rotation keeps the bristles standing erect. The bristles are brought into contact with a surface where the bristles displace any foreign material. The damage caused by the rotating bristles on the contact surface is minimized because the bristles are flexible and easily deform to the contours of the contacted surface. Yet the effectiveness of the present invention is superior to stiff bristles because the present invention bristles exist on a larger work surface and rotate at greater speeds.

Thus, although prior art does exist that has paint stripping devices comprised of wire bristles that are driven by the prime movers of power tools, prior art neither teaches nor suggests a paint stripping device that adapts to an existing string rotating grass trimming tool, using this tool's prime mover to provide the needed rotation. Prior art also fails to teach or suggest a paint stripping working head that holds replaceable flexible bristles in the manner shown by the present invention.

SUMMARY OF THE INVENTION

The present invention is directed toward a device that is adapted to the working end of a rotating string grass trimming tool. The standard string and spool end effector of the grass trimming tool is removed and the present invention is substituted in its place. The present invention is comprised of a drum which is rotated at a high rate of speed by the prime mover of the grass trimming tool. The drum has a plurality of flexible bristles extending from its circumferential surface. The centrifugal force of the rotating drum extends the flexible bristles away from the surface of the drum. The extended bristles are then brought into contact with a desired surface, removing any paint, rust or other unwanted material from the surface with a minimal of surface damage to that surface. The rate at which the present invention is rotated is controlled by the motor governing device of the grass trimming tool. The combination of the power, reach and safety of modern grass trimming tools when combined with the present invention results in a paint stripping device that is more efficient, effective, safe and economic in design than all other existing devices.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE PRESENT INVENTION

Figure 1:
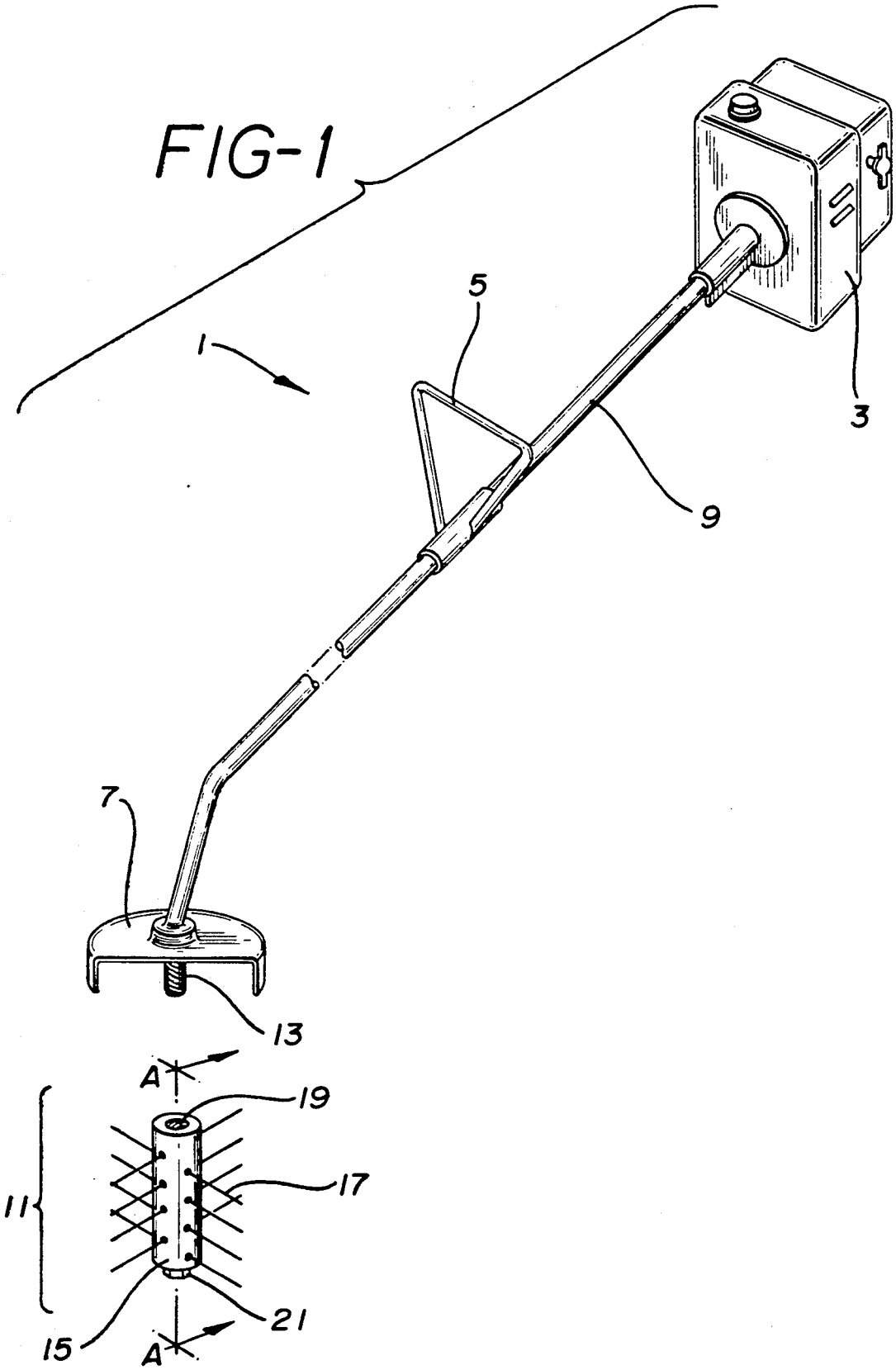
FIG. 1 shows a perspective view of one preferred embodiment of the present invention shown in combination with a rotating string type grass trimming tool.

The present invention is, as mentioned, directed toward a paint stripping device that adapts to a rotating string grass trimming tool. The prime mover of the grass trimming tool is used to rotate the invention. The invention is then brought into contact with a surface, wherein the invention removes paint, rust or other undesired materials.

Traditional paint stripping devices are composed of a plurality of radially extending wire bristles attached to a central hub. The hub usually has a drive rod extending from it, or an attachment orifice formed through it, so that the hub can easily be attached to some type of rotating power tool. The bristles extending from the hub are usually wire and are stiff enough to hold their orientation with the hub regardless of whether the hub is rotating. Traditional paint stripping working heads tend to be small and have a narrow band of bristles so that the limited power offered by common hand-held rotating power tools will not be overcome by the forces created by the paint stripping working head while engaging a surface. Since paint stripping jobs are often in overhead or hard to reach places, traditional paint stripping working heads are formed small to accommodate small light-weight power tools.

The limitations of power available by hand-held power tools dictates the design of traditional rotating paint stripping devices. The band of bristles extending from such devices is usually very narrow, because wide bristle bands result in increased friction, which in turn, may stress the hand-held power tool over its capacity. Similarly, traditional rotating paint stripping devices must have short diameters, so as not to overcome the torque capacities of power tools as the paint stripping device contacts a surface. Short diameter paint stripping devices also result in bristles that rotate at a low velocity, thus limiting the effectiveness of the bristles as they contact a desired surface. The combined effect of narrow bristle bands moving at low velocities makes traditional rotating paint stripping device inefficient, ineffective and time consuming to use. But since the only power source previously used to drive such paint stripping device has been electric power tools, such deficiencies in performance were unavoidably endured.

To maximize the effectiveness of traditional rotating paint stripping devices, manufacturers have created stiff bristles, usually made from a heavy gauge wire. The stiff bristles are capable of removing most foreign material from a surface but the heavy gauge wire bristles do not conform well to the contours of the engaged surface. The result is that stiff bristles damage the surface on which they are applied, gouging grooves, rounding corners and removing more material than is desired.

Another deficiency of traditional rotating paint stripping devices does not stem from performance, but stems from the orientation of such a device during use. Paint stripping devices are used to remove leaded paint, iron oxide and other materials that may be dangerous if inhaled or digested. Since rotating paint stripping devices turn such dangerous materials into a fine dust, it is important that a user be protected. Traditional paint stripping devices attach to relatively small hand-held power tools. This working orientation requires a user's hands and body to be close to the working surface, thus causing the user to cntact the dangerous materials.

The present invention eliminates all the above-discussed disadvantages of traditional rotating paint stripping devices by providing a device that can be attached to a rotating string grass trimming tool. Most every household in the suburbs of this country today owns some type of rotating string grass trimming tool. These grass trimming tools have a prime mover of either a high powered electrical motor, or a small internal combustion engine. The present invention utilizes the power available through these prime movers to rotate a large paint stripping device at high speeds. The present invention is essentially a drum, adaptable to the working end of a rotating string grass trimming tool. Replaceable flexible strands of wire or string are held by the drum. As the drum is rotated, a centrifugal force is created fully extending the strands away from the drum. The rotating strands are brought into contact with a desired surface wherein the strands engage a wide area, removing foreign materials from the full contour of the surface, while the flexible nature of the strands prevents damage to the underlying surface. The natural length and versatility of the rotating string grass cutting tool is now part of the present invention, keeping the user away from the working area and allowing the user to engage a large area of work with a minimal amount of bending or stretching.

Referring now to FIG. 1 there is shown a perspective view of one preferred embodiment of the present invention 11 shown in conjunction with a rotating string grass trimming tool 1. The grass trimming tool 1 shown has had its normal work end removed exposing a threaded shaft end 13 that is used to hold a standard working head supplied by the manufacture (not shown) onto the tool 1. The threaded shaft end 13 is one end termination of a drive shaft that rotates within the shaft body 9 of the grass trimming tool 1. The drive shaft, and consequently the threaded shaft end 13, are rotated by the prime mover 3 of the tool 1, in this embodiment the prime mover 3 being an internal combustion engine. The present invention embodiment 11 illustrated by FIG. 1 shows a circular drum 15 having a plurality of flexible strands 17 radially extending from its outer circumferential surface. The upper end of the circular drum is having a relief 19 form centrally thereon. The relief 19 is threaded, having a thread pitch and diameter sympathetic to the threaded shaft end 13. The relief 19 allows the present invention 11 to engage the threaded shaft end 13. The engagement of the threaded shaft end 13 with the invention 11 becomes tighter as the present invention 11 is rotated opposite to the rotation of the thread shaft 13. Once the drum relief 19 is fully threaded onto threaded shaft 13 the present invention 11 is fully connected to the grass trimming tool 1 and the present invention 11 will be rotated by the power of the prime mover 3.

Although the embodiment shown has a threaded relief 19 formed to engage the threaded shaft 13, it should be understood that a threaded sleeve or nut could be molded into the top of the drum 15, if the drum 15 were constructed of plastic. The embodiment shown merely expresses the best mode of the invention.

The flexible strands 17 radially extending from the drum 15 may be made of wire, plastic, nylon or any other durable flexible material. As the drum 15 is rotated by the power of the prime mover 3, the flexible strands 17 are forced away from the drum 15 by the centrifugal forces created by the rotation. The rotating strands 17 are brought into contact with a surface. Since plurality flexible strands 17 are positioned throughout the length of the drum 15, the present invention 11 contacts a fairly large portion of a surface at any one time. The flexibility of the strands 17 allows the rotating strands 17 to easily deform as they contact a contoured surface. The deformation of the strands 17 assure that the strands 17 will not gouge, or otherwise damage any surface they contact.

Since the drum 15 is driven by a powerful prime mover 3, the drum 15 can be rotated at a high speed and resist a large torque force. The high rate of revolutions assures that the flexible strands 17 are striking a desired surface with enough energy to displace any paint, rust or other foreign material that is so attached. Thus, since the impact velocity of the present invention strands is increased, the need for stiff wire bristles, that can damage surfaces, is removed.

Figure 2:
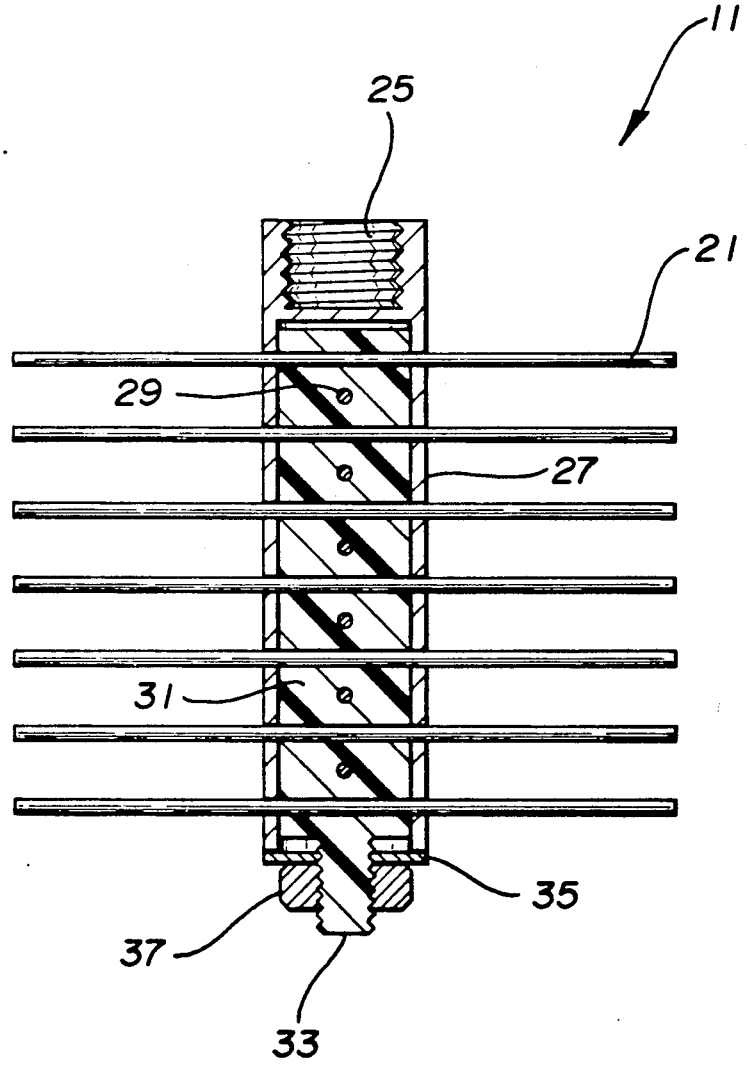
FIG. 2 shows a mid-cross sectional view of the preferred embodiment shown in FIG. 1 cut along section line A—A.

Referring to FIG. 2, the working of the present invention 11 can be better understood. FIG. 2 is an enlarged cross-sectional view of the present invention 11 shown in FIG. 1, cut along section line A—A. Like parts are like numbered. As seen from FIG. 2, the present invention 11 consists of a hollow 15 and a core 31. The core 31 and the drum 15 have a plurality of holes formed through their structures. The orifices 18 formed through the skin of the drum 15 are formed in parallel sets, each set of orifices 18 being in line with the center axis of the drum 15, offset from one another by 180 degrees. Similarly, the holes within the core 31 create clear, straight shafts 29 that pass through the center axis of the core 31. The orifices 18 within the skin of the drum 15, and the shafts 29 traversing the core 31, align to create a clear opening from one side of the present invention 11 to the other. Once the drum 15 and core 31 are properly aligned, a plurality of flexible strands 17 can pass through the drum 15 and the core 31 guided by the drum orifices 18 and the core shafts 29.

The presence of the flexible strands 17 prevent the core 31 from leaving the drum 15. The drum 15 itself has two, one end having a threaded relief 19 formed in it, and the other end being open. The core 31 fits into the drum 15 through the open end. The core 31 has a threaded neck 33 that extends beyond the open end of the drum 15. An optional washer 35 is placed around the neck 33 and a nut 21 is tightened down to the washer 35. As the nut 21 is further tightened, the core 31 is pulled downward and the shafts 29 traveling through the core 31 no longer directly align with the orifices 18 formed in the skin of the drum 15. The displacement of the core 31 pinches the plurality of flexible strands between the core shafts 29 and the drum orifices 18. The pinching action holds the flexible strands 17 firmly in place as the invention 11 is rotated. If one or more flexible strands 17 needs replacement, the nut 21 is loosened, the strands 17 removed and the procedure reversed with a new strand.

Although FIG. 2 shows a washer 35 used between the drum 15 and the nut 21, it should be understood that such a washer 35 would not be necessary if the nut 21 was adequately sized. It should also be understood that although FIG. 2 shows a metal drum 15 and a plastic core 31, they need not be made of these materials. FIG. 2 merely illustrates the best mode of the invention, using metal to optimize strength and plastic to minimize weight and inertia.

Figure 3:
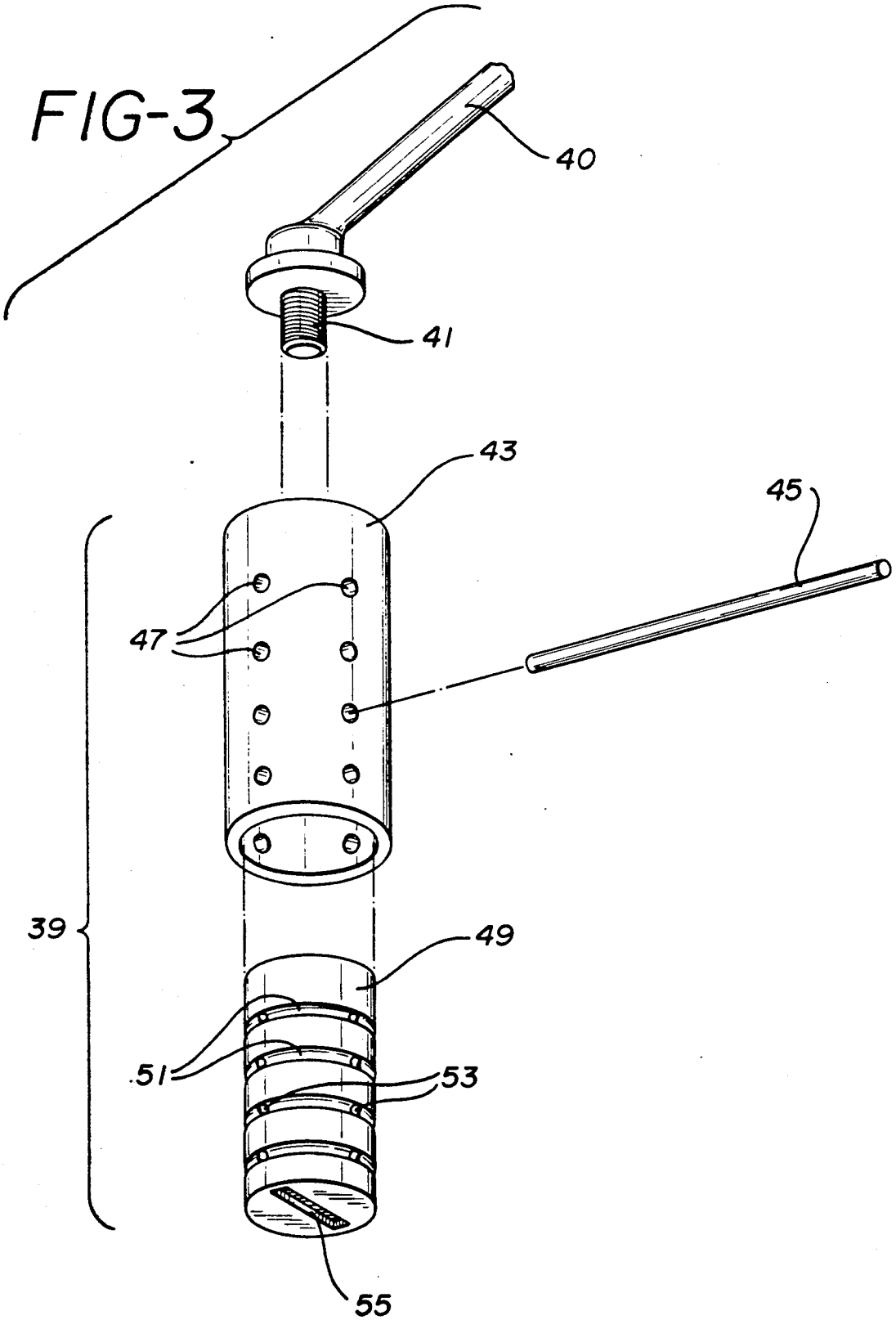
FIG. 3 shows an exploded perspective view of a differing embodiment of the present invention.

Referring to FIG. 3, a differing embodiment of the present invention 39 is shown in an exploded perspective view. FIG. 3 also shows a fragmented view of the working end of a typical string rotating grass trimming tool, orienting the working position of the invention 39. As is shown, the embodiment of the present invention 39 consists of a drum 43 and a core 49. The drum 43 is of the same construction previously shown in FIGS. 1 and 2. The drum 43 has two ends. One end is open, and the other end (not shown) having a threaded relief within it to positively engage the threaded shaft end 41 of the rotating grass trimming tool. The drum 43 has a series of sets of orifices 47 through its circumferential skin that are parallel and aligned directly across from one another. Similarly, the show core 49 has a plurality of open shafts 53 passing through its body. The open shafts 53 in the core 49 align with the orifices 47 within the drum 432, when the core 49 is properly positioned within the drum 43. Flexible strands 45 can then pass through the drum 43 and the core 49, guided by the orifices 47 and shafts 53.

The core 49 also has a series of rounded grooves 51 formed on its surface, each groove being parallel to, and passing over, one core shaft 53. Each groove 51 has a radius smaller than the diameter of a flexible strand 45, assuring that a flexible strand 45 could not fully fit into one of the formed grooves 51. Once the core 49 is placed within the drum 43 and the drum orifices 47 are aligned with the core shafts 53, flexible strands 45 are passed through. Once all the flexible strands 45 are placed, the core 49 is rotated. The shown embodiment of the core 49 has a screwdriver turn slot 55 created in its base. It should be understood that any orientation of slots, reliefs or extensions can be used in place of the shown slot 55 to turn the core 49.

Once turned, the shafts 53 within the core no longer align with the drum orifices 47. The flexible strands 45 are stressed and are pulled along the sides of the core 49 as the core 49 is rotated. The flexible strands 45 fall into the grooves 51 formed into core 49. Since the flexible strands 45 are larger than the slotted grooves 51, the flexible strands 45 become wedged between the core grooves 51 and the inside wall of the drum 43. The locking force created by the wedging action increases as the core 49 is turned further and further. Eventually, the locking force created is sufficient to hold the flexible strands 45 into place as the invention 39 is rotated. To replace a broken or worn strand 45, the core 49 is rotated until the shaft 53 again align with drum orifices 47, the broken strand is replaced and the locking procedure is repeated.

Although the embodiments of the invention shown in FIGS. 1, 2, and 3 depict a drum with an annular circumferential surface, it should be understood that the drum may have any shape or form, provided the drum had an even weight distribution about its center of rotation. It should also be noted that the flexible strands of the persent invention could be formed from any durable material that does not fray or tear easily.

Obviously, numerous modifications, variations and combinations of the present invention are possible in light of the above teachings and illustrations. It is therefore understood that although the best modes of the present invention have been shown, that within the scope of the appended claims, the invention may be practiced otherwise than as specifically described or shown herein.

What is claimed is:

1. A paint stripping attachment apparatus for a rotating string grass trimming tool, wherein said grass trimming tool has a working head so attached by a threaded shaft, said attachment apparatus comprising:

a) a substantially hollow drum having two ends, a first end being open, and a second end being solid, having a means of attachment between said drum and said threaded shaft formed thereon, said drum having a plurality of orifices formed therethrough between said first and second ends;

b) a core having a plurality of core orifices formed therethrough, said core fitting within said first end of said drum, said core orifices aligning with said orifices on said drum, creating a plurality of open passages through said drum and said core;

c) a plurality of flexible strands, one said strand traveling through each of said open passages within said drum and said core, each said strand extending outwardly from said drum at both ends of said open passage; and d) a core displacement means whereby said plurality of core orifices traversing said core are temporarily forced out of alignment with said plurality of orifices fromed through said drum, the displacement of said core orifices pinching said plurality of flexible strands between said drum and said core, temporarily locking said strands into place;

wherein said core has a threaded neck formed thereon, said threaded neck extending below said drum when said core is within said drum, and wherein said core displacement means is a nut that tightens around said threaded neck, said nut contacting said first end of said drum and forcing said core toward said first end of said drum, the movement of said core within said drum pinching said flexible strands between said orifices on said drum and said core orifices, locking said flexible strands into place.

2. The apparatus of claim 1 wherein said means of attachment on said second end of said drum is a threaded relief formed to positively engage said threaded shaft.

3. The apparatus of claim 2 wherein said threaded relief is molded within the material of said second end.

4. The apparatus of claim 1 wherein said drum has a height of at least four inches.

5. The apparatus of claim 1 wherein said core is molded from plastic.

6. The apparatus of claim 1 wherein each said flexible strand can be selectively added or removed from said apparatus.

7. The apparatus of claim 1 wherein said apparatus has at least six flexible strands extending therefrom.

8. The apparatus of claim 1 wherein said flexible strands are elastically deformable into any orientation.

9. The apparatus of claim 8 wherein said flexible strands are manufactured from a plastic material.

10. The apparatus of claim 8 wherein said flexible strands are manufactured from metal.

11. A paint stripping attachment apparatus for a rotating string grass trimming tool, wherein said grass trimming tool has a working head so attached by a threaded shaft, said attachment apparatus comprising:

a) a substantially hollow drum having two ends, a first end being open, and a second end being solid, having a means of attachment between said drum and said threaded shaft formed thereon, said drum having a plurality of orifices formed therethrough between said first and second ends;

b) a core having a plurality of core orifices formed therethrough, said core fitting within said first end of said drum, said core orifices aligning with said orifices on said drum, creating a plurality of open passages through said drum and said core;

c) a plurality of flexible strands, one said strand traveling through each of said open passages within said drum and said core, said strands preventing said core from leaving said drum, each said strand extending outwardly from said drum at both ends of said open passage; and d) a core displacement means whereby said plurality of core orifices traversing said core are temporarily forced out of alignment with said plurality of orifices formed through said drum, the displacement of said core orifices pinching said plurality of flexible strands between said drum and said core, temporarily locking said strands into place;

wherein said core has a plurality of grooves formed thereon, one said groove being in the same plane as each said open passage and having a depth less than the height of said flexible strands and wherein said core displacement means is a shaped relief formed on said core, said relief allowing said core to be rotated about its center axis, within said drum, by a hand tool.

12. The apparatus of claim 11 wherein the rotation of said core by said displacement means within said drum causes said plurality of flexible strands to fall within said plurality of grooves on said core, said plurality of flexible strands becoming wedged between said core and said drum until the friction created by said flexible strands overcomes the rotational force created by said displacement means.

13. The apparatus of claim 11 wherein said means of attachment on said second end of said drum is a threaded relief formed to positively engage said threaded shaft.

14. The apparatus of claim 13 wherein said threaded relief is molded within the material of said second end.

15. The apparatus of claim 11 wherein said drum has a height of at least four inches.

16. The apparatus of claim 11 wherein said core is molded from plastic.

17. The apparatus of claim 11 wherein each said flexible strand can be selectively added or removed from said apparatus.

18. The apparatus of claim 11 wherein said apparatus has at least six flexible strands extending therefrom.

19. The apparatus of claim 11 wherein said flexible strands are elastically deformable into any orientation.

20. The apparatus of claim 19 wherein said flexible strands are manufactured from a plastic material.

* * * * *